US010413145B1

(12) United States Patent
Ebrahimi Afrouzi et al.

(10) Patent No.: US 10,413,145 B1
(45) Date of Patent: Sep. 17, 2019

(54) ROBOTIC VACUUM WITH ROTATING CLEANING APPARATUS

(71) Applicants: Ali Ebrahimi Afrouzi, San Jose, CA (US); Soroush Mehrnia, Copenhagen (DK); Azadeh Afshar Bakooshli, San Jose, CA (US)

(72) Inventors: Ali Ebrahimi Afrouzi, San Jose, CA (US); Soroush Mehrnia, Copenhagen (DK); Azadeh Afshar Bakooshli, San Jose, CA (US)

(73) Assignee: AI Incorporated, Toronto (CA)

( * ) Notice: Subject to any disclaimer, the term of this patent is extended or adjusted under 35 U.S.C. 154(b) by 0 days.

(21) Appl. No.: 15/878,228

(22) Filed: Jan. 23, 2018

Related U.S. Application Data

(63) Continuation of application No. 14/922,143, filed on Oct. 24, 2015, now Pat. No. 9,901,234.

(51) Int. Cl.
*A47L 9/28* (2006.01)

(52) U.S. Cl.
CPC ..... *A47L 9/2831* (2013.01); *A47L 9/2852* (2013.01); *A47L 2201/04* (2013.01); *A47L 2201/06* (2013.01)

(58) Field of Classification Search
CPC .. A47L 9/2831; A47L 9/2852; A47L 2201/06; A47L 2201/04; A47L 9/28
USPC ..... 15/319, 339
See application file for complete search history.

(56) References Cited

U.S. PATENT DOCUMENTS 5,720,077 A * 2/1998 Nakamura ..... A47L 11/4061 15/319
9,901,234 B1 * 2/2018 Ebrahimi Afrouzi ..... A47L 9/2831
2013/0192019 A1 * 8/2013 Weis ..... A47L 11/32 15/319

* cited by examiner

*Primary Examiner* — David Redding

(57) ABSTRACT

A method for increasing the rate of debris collection of a robotic vacuum through increasing the number of times a robotic vacuum's cleaning apparatus passes over a work surface during each pass of the device. The device's main cleaning apparatus is installed on a plate that rotates within the housing of the device. The drive unit is housed separately from the rotating plate so that the device's normal movement patterns will be uninterrupted by the rotation of the cleaning apparatus. Ideally, the cleaning apparatus will be caused to rotate two or more times over an area before the robotic vacuum has driven completely through the area.

4 Claims, 2 Drawing Sheets

ROBOTIC VACUUM WITH ROTATING CLEANING APPARATUS

CROSS-REFERENCE TO RELATED APPLICATIONS

This is a continuation of U.S. patent application Ser. No. 14/922,143 entitled "Robotic Vacuum with Rotating Cleaning Apparatus" filed Oct. 24, 2015, which is a Non-Provisional patent application of U.S. Provisional Patent Application No. 62/068,579, filed Oct. 24, 2014 all of which are herein incorporated by reference in their entireties for all purposes.

FIELD OF INVENTION

The present invention relates to automatic floor cleaning systems.

BACKGROUND OF INVENTION

The following is a tabulation of some prior art that presently appears relevant:

U.S. Patent Documents

| Pat. No. | Kind Code | Issue Date | Patentee |
|---|---|---|---|
| 7,568,259 | B2 | Aug. 4, 2009 | Jason Yan |
| 9,119,512 | B2 | Sep. 1, 2015 | Martins Maintenance, Inc. |
| 8,839,477 | B2 | Sep. 23, 2014 | Irobot Corporation |
| 8,087,117 | B2 | Jan. 3, 2012 | Irobot Corporation |
| 7,571,511 | B2 | Aug. 11, 2009 | Irobot Corporation |
| 8,516,651 | B2 | Aug. 27, 2013 | Irobot Corporation |
| 6,883,201 | B2 | Apr. 26, 2005 | Irobot Corporation |
| 7,474,941 | B2 | Jul. 24, 2003 | Samsung Gwangju Electronics Co., Ltd. |

Robotic vacuums have becoming increasingly popular to clean floors in modern homes. However, robotic vacuums frequently do not collect all of the debris on a work surface in a single pass. Several solutions to increase the efficiency of these devices have been attempted. Robotic vacuums have been equipped with different mechanisms, such as more dense brushes and more powerful vacuuming motors to reduce the possibility of leaving behind debris. Another solution is to use more intensive movement patterns that cause the device to cover areas more than once, however this solution increases the length of time required to adequately service an area.

A need exists for a method to increase the rate of debris collection of a robotic vacuum cleaner that does not increase the length of time to clean an area. A need exists for a solution that may be combined with other methods of increasing cleaning power.

SUMMARY OF INVENTION

It is a goal of the present invention to increase the rate of debris collection of a robotic vacuum cleaner.

It is a goal of the present invention to increase the efficiency of a robotic vacuum cleaner.

It is a goal of the present invention to provide a solution that can be combined with other methods to further increase cleaning efficiency.

The present invention achieves the aforementioned goals through a robotic vacuum design in which the cleaning apparatuses are housed on an independently rotating plate within the device. The plate rotates in a plane parallel to the plane of the work surface as the device drives through the work area. The rotating cleaning apparatus causes the vacuuming elements to pass multiple times over areas that the vacuum traverses as it is moving.

DETAILED DESCRIPTION OF THE INVENTION

The present invention will now be described in detail with reference to a few embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

Various embodiments are described below, including methods and techniques. The disclosure described herein is directed generally to a robotic vacuum with a rotating cleaning apparatus.

As understood herein, the term "robotic vacuum" may be defined generally to include one or more autonomous devices having communication, mobility, vacuuming and/or processing elements. For example, a robotic vacuum may comprise a casing or shell, a chassis including a set of wheels, a motor to drive wheels, a receiver that acquires signals transmitted from, for example, a transmitting beacon, a processor, and/or controller that processes and/or controls motor and other robotic autonomous or cleaning operations, network or wireless communications, power management, etc., one or more clock or synchronizing devices, a vacuum motor to provide suction, a debris dustbin to store debris, a brush to facilitate collection of debris, and a means to spin the brush.

Generally, a robotic vacuum with two sections, one of which spins in a plane parallel to the plane of the work surface, is proposed. The inner section houses the cleaning apparatuses, vacuum motor, and debris container. The outer section supports the inner section and houses all the other robotic vacuum components as well as a means to rotate the inner section within the outer section. The rotating action allows the cleaning apparatuses to pass multiple times over the portion of the work surface that the vacuum is traveling over as it moves. This increase in coverage results in a more thoroughly cleaned area.

Figure 1:
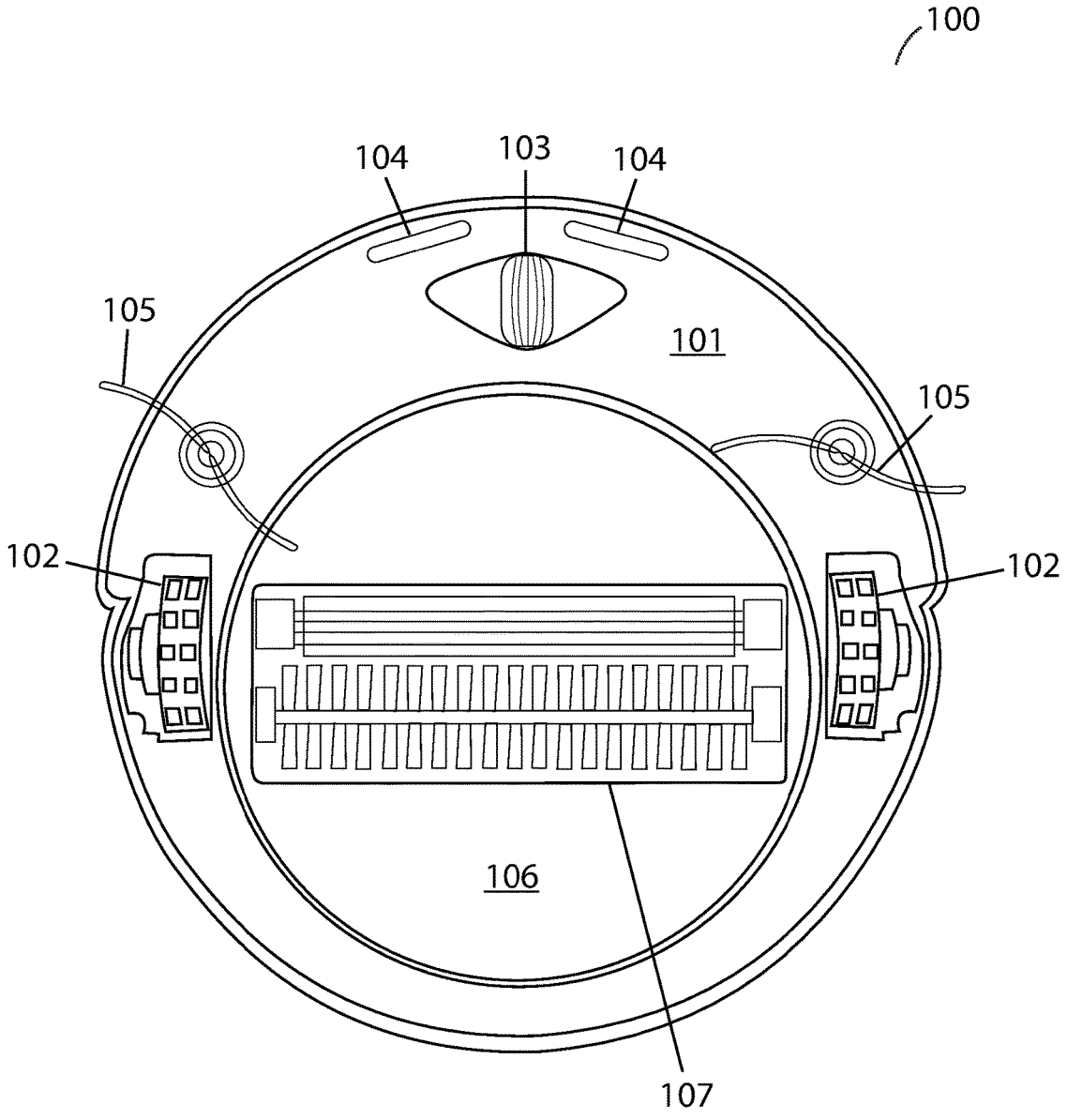
FIG. 1 illustrates is an overhead view of the underside of a robotic vacuum with a rotating cleaning assembly embodying features of the present invention.

Referring to FIG. 1, an overhead view of the underside of a robotic vacuum 100 with a rotatable cleaning apparatus is illustrated. An outer section 101 of the robotic vacuum houses all the stationary components, including driving wheels 102, steering wheel 103, a control system (not shown), batteries (not shown), and a means to rotate the inner section (not shown). The outer section may further house other components without limitation. The robotic vacuum components shown are included for illustrative purposes only and are not intended to limit the invention to the particular design shown. In the example shown, the outer section further houses sensors 104 and side brushes 105. An inner section 106 of the robotic vacuum is supported by and rotates within the outer section. The inner section houses the main cleaning apparatuses 107, vacuum motor (not shown), and debris container (not shown).

Figure 2A:
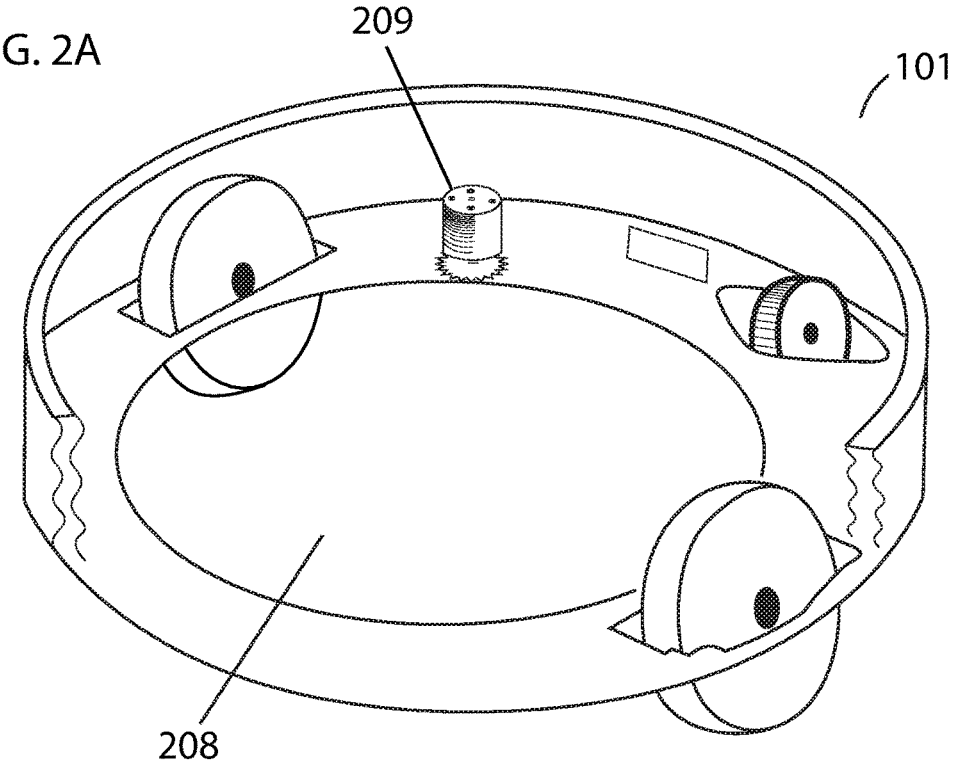
FIG. 2A illustrates a cutaway of a perspective view of the outer section of a robotic vacuum embodying features of the present invention.
Figure 2B:
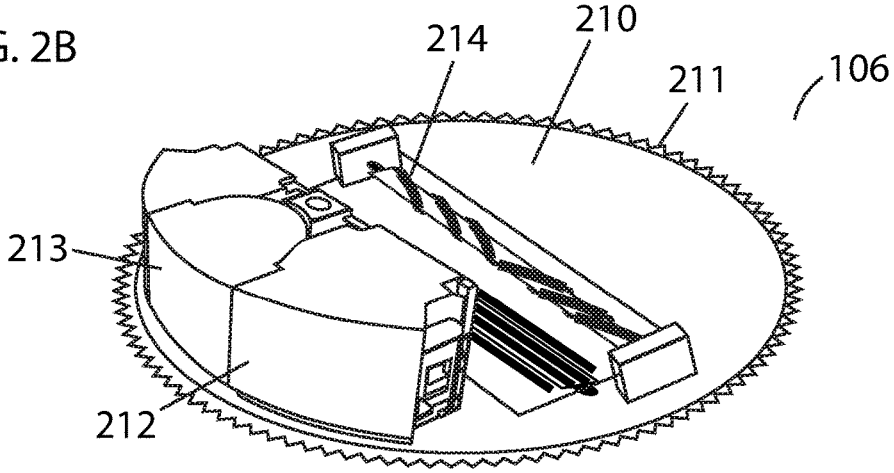
FIG. 2B illustrates a perspective view of the inner section of a robotic vacuum embodying features of the present invention.

Referring to FIG. 2A, a cutaway of a perspective view of the outer section 101 of the robotic vacuum is illustrated. The opening 208 is where the inner section, depicted in FIG. 2B, is installed. An electric motor and set of gears 209 rotate the inner section.

Referring to FIG. 2B, a perspective view of the inner section 106 of the robotic vacuum is illustrated. The inner section comprises a plate 210 with a serrated edge 211 that engages with the gear set in FIG. 2A to rotate the inner section. The debris container 212, vacuum motor 213, and cleaning apparatus 214 are installed on the inner section.

In the preferred embodiment, as the robotic vacuum drives through an area, the motor and gear set rotate the plate of the inner section so that the cleaning apparatus rotates in a plane horizontal to the work surface. In the preferred embodiment, the rate of rotation of the inner section in relation to the driving speed of the wheels is fast enough the cleaning apparatuses are caused to pass over substantially the same area two or more times before the robotic vacuum drives out of that area.

We claim:

1. A mobile robotic cleaning apparatus comprising two sections: an outer section comprising:

a casing or shell;

a chassis;

a set of wheels to drive the chassis;

one or more steering wheels;

a control system to instruct movement of the wheels;

a battery to provide power to the system;

an electric motor and gear set to rotate an inner section inside of said outer section, said inner section comprising:

a plate with a serrated edge interlocking with said gear set to facilitate rotation of said inner section, one or more cleaning apparatuses coupled to said plate for facilitating the removal of debris from a work surface;

a debris container coupled to said plate for storing collected debris; and a vacuum motor or impeller coupled to said plate;

whereby said inner section is rotated by said electric motor and gear set within said outer section as said mobile robotic cleaning apparatus drives through a work space.

2. The mobile robotic cleaning apparatus of claim 1 wherein said electric motor rotates at a speed that causes the one or more cleaning apparatuses to pass over the same area three or more times before said mobile robotic cleaning apparatus drives out of that area.

3. The mobile robotic cleaning apparatus of claim 1 wherein said one or more cleaning apparatuses are a vacuum and brush.

4. The mobile robotic cleaning apparatus of claim 1 wherein said inner section rotates in a plane parallel to the work surface being operated on.

* * * * *